US006808165B1

(12) United States Patent
Sperber, Jr. et al.

(10) Patent No.: US 6,808,165 B1
(45) Date of Patent: Oct. 26, 2004

(54) APPARATUS FOR MIXING AND INTRODUCING GAS INTO A LARGE BODY OF LIQUID

(75) Inventors: David O. Sperber, Jr., Huntington Beach, CA (US); Ernest W Downs, Cathedral City, CA (US); Fredric H. Avers, Jamul, CA (US); Jack Gorby, Los Angeles, CA (US); Stephen Dashew, Tucson, AZ (US)

(73) Assignee: Smith & Loveless, Inc., Lenexa, KS (US)

( * ) Notice: Subject to any disclaimer, the term of this patent is extended or adjusted under 35 U.S.C. 154(b) by 0 days.

(21) Appl. No.: 10/427,555

(22) Filed: Apr. 30, 2003

(51) Int. Cl.[7] ..... B01F 3/04
(52) U.S. Cl. ..... 261/87; 261/120; 261/122.1
(58) Field of Search ..... 261/87, 91, 120, 261/122.1, DIG. 71; 210/221.2, 242.2

(56) References Cited

U.S. PATENT DOCUMENTS

| | | | |
|---|---|---|---|
| 915,372 A | | 3/1909 | Neill |
| 1,124,855 A | | 1/1915 | Callow et al. |
| 1,383,881 A | | 7/1921 | Thomas |
| 2,138,349 A | | 11/1938 | Mallory |
| 2,187,746 A | | 1/1940 | Letevre |
| 2,239,194 A | | 4/1941 | Fitzgerald et al. |
| 2,328,655 A | | 9/1943 | Lannert |
| 3,630,498 A | | 12/1971 | Bielinski |
| 3,662,781 A | | 5/1972 | Figliola et al. |
| 3,677,528 A | | 7/1972 | Martin |
| 3,775,307 A | | 11/1973 | McWhirter et al. |
| 3,911,064 A | | 10/1975 | McWhirter et al. |
| 3,992,491 A | * | 11/1976 | Ihrig et al. ..... 261/87 |
| 4,229,302 A | | 10/1980 | Molvar |
| 5,681,509 A | | 10/1997 | Bailey |

FOREIGN PATENT DOCUMENTS

| | | |
|---|---|---|
| AT | 195354 | 1/1958 |
| DE | 2023981 | 11/1971 |
| FR | 1250266 | 11/1960 |
| GB | 955879 | 4/1964 |

* cited by examiner

*Primary Examiner*—Scott Bushey
(74) *Attorney, Agent, or Firm*—Wood, Phillips, Katz, Clark & Mortimer

(57) ABSTRACT

An gas diffusion device for introducing gas into a large body of liquid having at least one diffuser blade that engages over a mounting tube having a spar affixed to its exterior. A passage in the diffuser blade is dimensioned to cooperatively engage over the spar and mounting tube which holds the diffuser blade top surface at a determined angle once so engaged thereover. Changing the position of the spar on the exterior of the mounting tube in relation to the center axis of the mounting tube changes the resulting angle of the diffuser blade top surface. The diffuser blade can be attached to a hub mounted on a mainshaft that automatically cantilevers out of the fluid should compressed gas supplied to the diffuser blade through the mainshaft cease to avoid damage to the diffuser blade and diffuser pad on the blade from particulate in the liquid.

20 Claims, 4 Drawing Sheets

FIG. 5a
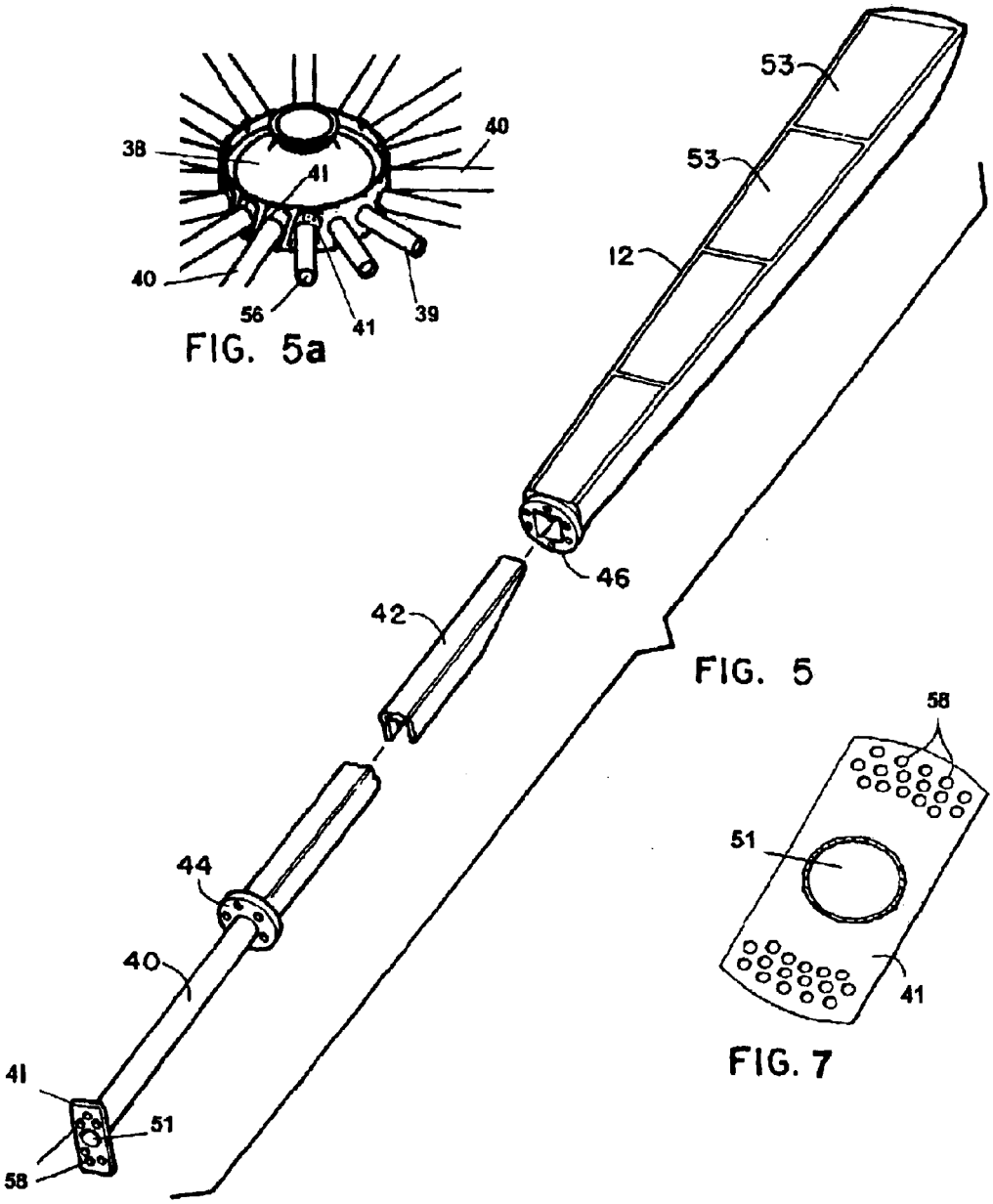
FIG. 5
FIG. 7
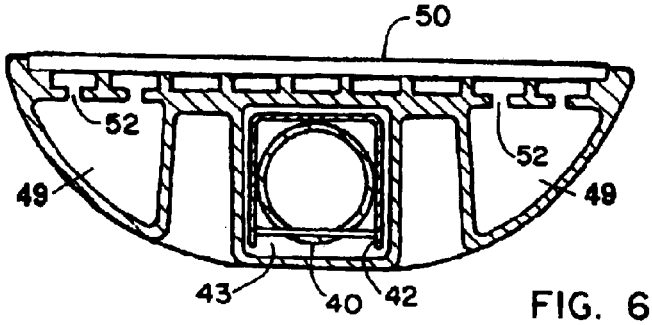
FIG. 6

APPARATUS FOR MIXING AND INTRODUCING GAS INTO A LARGE BODY OF LIQUID

FIELD OF THE INVENTION

The disclosed device herein relates to the field of aeration and mixing of large bodies of fluid. More particularly, the present invention is an improved apparatus for the introduction of gas and dissolved gases into a large body of liquid and for concurrently providing the ability to mix the liquid in a large body of liquid.

BACKGROUND OF THE INVENTION

Aeration and mixing have been used for treating water and other liquids for more than one hundred years. During that time various devices and methods have been employed for the mixing and aeration of such large bodies of fluid. Such aeration devices include compressor/diffusers, surface aerators, turbine/spargers, jet aerators, blade diffusers, with each having its own utility when it comes to the task at hand.

Compressor/diffuser type aerators employ a compressor suitable to the task to force gas through a diffuser located below the liquid surface. As the bubbles naturally rise to the surface of the liquid being aerated, gas is imparted from the bubbles into the liquid. Resulting mixing of the liquid is provided by the hydraulic resistance of the bubbles as they travel to the liquid surface.

Diffuser type aereators range from coarse bubble to fine bubble diffusers. Coarse bubble systems as the name implies employ larger bubbles and are more reliable but less energy-efficient to operate, when compared to fine bubble systems. Fine bubble diffusing systems, while at first more energy-efficient, frequently become fouled or clogged due to the small apertures required to produce the small bubbles clogging thereby resulting in decreased reliability. Such fine-bubble diffusers, in particular, are limited in low volume capability, due to increased fouling problems at lower gas flow rates.

Compressor diffuser type devices employ a rotating gas diffuser in the form of a large flat horizontal disk-shaped component. Compressed gas is therein discharged from porous plates arranged completely around the circumference of the disk. This type of gas deployment into the liquid tends to produce gas flow where many of the bubbles tend naturally to follow in the path of preceding bubbles which limits the efficiency of the transfer of gas into the surrounding body of liquid. Such a bubble pattern also tends to interrupt the effective inflow of liquid into the reactor column and therefor further limits mixing efficiency. Such a device is shown in U.S. Pat. No. 3,630,498 (Belinski) which teaches the use of a small, high-speed rotating mixing and an aerating element comprising a pair of horizontal radially extending blades or foils. In operation of Belinski, a partial vacuum is formed in a zone of cavitation behind the foils. Gas bubbles which emerge from the blades enter this zone of cavitation and expand due to the reduced pressure around the bubbles. While expanded, the bubbles are shattered by hydraulic forces into smaller bubbles. These smaller bubbles then exit the reduced pressure zone of cavitation and are further reduced in size as they are subjected to ambient pressure. Critical to the Belinski patent is the creation of the zone of cavitation. To create this zone of cavitation in a practical device, the foils must be short (such as 24 inches) and rotated at very high speeds (such as 450 RPM). Consequently, such a device is best suited for a smaller area.

If the foils are made appreciably longer, the energy cost and physical loads of high-speed rotation quickly become prohibitive.

Surface aerators employ an engine or motor to rotate impellers or blades near the surface of the liquid body. Such devices conventionally either lift the water into the air above the surface, or aspirate air and inject it just below the surface of the liquid body. Surface aerators in general possess a poor gas transfer efficiency when compared to fine bubble diffused aeration systems since they consume more horsepower hours of energy for each pound of dissolved oxygen they produce. Mixing from surface aerators is generally limited to liquid at or near the surface of the body of fluid being aerated. Further, mixing energy tends to be point limited to positions at or near the impeller. Consequently, localized zones of high shearing forces tend to damage delicate floc structures necessary for proper liquid clarification. Further, surface aerators are generally limited in the length of the shaft overhang, and shaft bearing life tends to be problematic.

Turbine/Spargers aerators use compressors to force and distribute gas below the surface of the liquid body. They also employ a submerged impeller positioned just above the diffuser(sparger), to shear the bubbles and provide bulk mixing of the liquid body in which they reside. Disadvantages of turbine spargers are similar to those for surface aerators with the additional disadvantage caused by the turbine sparger requiring an independent source of compressed gas such as a compressor.

Jet Aerators employ a liquid pump and an eductor to impart gas into the liquid body surrounding them using the Venturi principle. Such a system is taught in U.S. Pat. No. 4,101,286 (Nagao). Such jet aeration systems may also be equipped to mix additional gas, liquid, or solid chemicals into the liquid body into which they are engaged. While such systems are generally reliable and have good low volume capability, they tend to be inefficient aerators.

Blade diffusers as taught in U.S. Pat. No. 1,383,881 (Ingram) use a flotation apparatus having rotating blades which dispense gas bubbles into the surrounding body of liquid. The design of these blades is dictated, however, by the requirement that they also act as impellers to rotate the blades as well as discharging the gas bubbles. Such blades are pitched so that the leading edges are elevated about 45 degrees and as a result, the emerging gas is formed into elongated and then enlarged bubbles, which result in a less efficient introduction of the gas into the liquid. In addition, examination of the patent and our research indicates that the blades would rotate in the opposite direction than is indicated in the Ingram Patent. This would result from the upward flow of fluid caused by the fluid lift pump effect of the released gas moving upward toward the liquid surface. Such a vertical water flow across the pitched blades would appear to in fact cause rotation opposite that which is taught in Ingram.

Another excellent example of a device for aeration and mixing of large bodies of liquid is taught in U. S. Pat. No. 5,681,509 (Bailey). Bailey teaches an apparatus and method for mixing and introducing gas into a large body of liquid by rotating a plurality of permanently mounted spoke-like discharge members which are below the surface of the liquid body. These members have upwardly facing perforated discharge surfaces through which compressed gas is released up into the liquid. Upward lift is countered by angling the members which are tilted with their leading edges lower than their trailing edges and balancing the rotation speed to achieve substantially zero lift. A control system is provided to change the depth of submergence of the discharge members to regulate dissolved gas infusion rate and speed of member rotation to maintain angle of attack. Bailey, while a leader in this field, teaches the use of permanantly mounted blade members which are self supporting for the load forces encountered and which can prove labor intensive to change if needed. Bailey also teaches the use of a vertically inclining main shaft which, while providing valuable utility in the ability to raise the blade members from the liquid in which they rotate, does require a substantial frame and mechanical structure to support the components allowing for the inclining main shaft.

As such, there exists a need for a device for mixing and for introducing gas into a large body of liquid which is easily servicable and energy efficient. Such a device should provide maximum aeration and mixing to the water to which it is immersed and also provide easy ingress and egress of the diffuser blades from the water or liquid being aerated. Such a device should best use diffuser blades that are adaptable for attachment and use with prior systems for aeration to improve on their performance as well as in new installations with frame components designed to further enhance the aeration, energy, and servicing characteristics the device offers. Such a system would best use diffuser blades which are light weight due to transference of loading to load bearing members thereby reducing costs of manufacture and aiding in ease of installation.

SUMMARY OF THE INVENTION

The device as herein disclosed features an improved diffuser blade that provides excellent aeration characteristics as well as a highly improved mounting scheme to the rotating hub which provides both compressed gas and rotation to the diffuser blade. The improved mounting system of the diffuser blade enhances both installation of the diffuser blades during the initial installation as well as during removal and reinstallation for maintenance. The improved diffuser blade is mounted on the disclosed support and operating structure and yields maximum utility due to the combined characteristics of the tilting support structure and easily mountable diffuser blades. Or disclosed diffuser blades may also be used to improve currently installed rotational aeration devices if adapted for cooperative installed engagement with aeration systems already in existence to thereby enhance the performance and improve the serviceability of such existing systems.

The disclosed device herein consists of two main components in the form of a support frame which floats upon the liquid and diffuser blades which rotate when immersed in the liquid to aerate the liquid. The frame is mounted upon a means for floatation or continued elevation above a liquid pool such as pontoons or on another means to elevate it above a liquid pool such as a bridge or pier, and provides a platform for a tilting main shaft, a connection to a compressed air source, and a means to rotate a tiltable vertical main shaft such as an electric motor. The frame component features a unique attachment to the main shaft in that the main shaft is rotationally engaged with the frame and can be tilted or cantilevered upward and out of the water or liquid to either mount or service the diffuser blades to the main shaft or during power failures or other times when the diffuser blades need to be raised from the liquid to protect them from clogging.

The diffuser blades attached to the lower or distal end of the main shaft employ a rectangular spar which is cooperatively engaged about its outer surface in a similarly shaped passage formed internally on the diffuser blade. The blade engaging spar is attached in a fixed position about the exterior surface of a mounting tube which either mounts directly to the hub of the main shaft or the mounting tube overlaps a nipple protruding from the hub which is attached to the main shaft. Once engaged for rotation by the main shaft, the mounting tube and spar project substantially normal from the center axis of the main shaft. A pair of cooperatively engageable mounting collars with one affixed on the mounting tube and the other upon the mounting end of the diffuser blade, allow for attachment of the diffuser blade with the mounting tube with the spar engaged with both the exterior of the mounting tube and internally on the diffuser blade. The spar being engaged in a cooperatively engaging passage in the diffuser blade, provides structural support to the diffuser blade during rotation through the fluid and provides support to the diffuser blade in maintaining the angle of attack during rotation in the liquid.

This novel interlocking of the spar with the mounting tube and using a co-operatively engaging passage axially located in the diffuser blade, to engage the diffuser blade upon the spar, allows for easy mounting and dismounting of the diffuser blade to the mounting tube and spar, for both installation and for maintenance or replacement. Further, the provision of the metal spar, which cooperatively engages internally with a passage in the diffuser blade, provides reinforcement to the diffuser blade against the plurality of vector forces imparted upon the diffuser blade when rotating at the determined best angle of attack through the fluid in which it is immersed. This spar and diffuser blade engagement transfers a substantial portion of the vector forces imparted to the diffuser blade including the twisting force and the lateral force imparted to the diffuser blade at the angle of attack during rotation of the main shaft in operative communication with the mounting tube and the nipple. This transfer of force using the spar engaged in the cooperative passage thus allows the diffuser blade itself, and its mounting collar, to be made from much lighter material than if the diffuser blade was required to support the twisting and lateral forces generated by rotating at an angle in the fluid. Further, the current preferred spar engaging the cooperative passage in the diffuser blade has a generally "u" shape about it and provides an excellent path for disbursement of compressed gas communicated through the center of the mounting tube up and through the face of the diffuser blade.

The attachment of the diffuser blade engaged over the rectangular shaped spar on the mounting tube, using the mating mounting collars to primarily maintain the diffuser blade upon the spar, also allows for the diffuser blade to be operatively positioned at a determined angle of attack when circulating through the fluid. The desired angle of attack may be achieved using one or a plurality of provided means for rotational engagement of the diffuser blade to the hub. This angle of attack is determined by either first positioning of the spar on the mounting tube in a fixed attachment such that it is at the proper angle to maintain the diffuser blade at the desired angle of attack when inserted thereover, or by taking a mounting tube with an affixed spar thereon, and cooperatively engaging it with the hub with the spar at the correct point to yield the proper angle to an attached diffuser blade. Either means to fix the spar at the proper angle extending from the hub could be used and yield a diffuser blade engaged over the spar with the diffuser blade at the desired angle of attack with the spar absorbing most of the force imparted to the diffuser blade from circulating angled in the fluid.

In order to maximize the shearing effect of the flow of liquid relative to the rotating diffuser blades, it is desirable that the resultant angle of attack of the discharge surfaces of the diffuser blades, with regard to the relative liquid flow, be essentially zero or somewhat greater. In other words, such flow should be generally parallel to or tangential to such surfaces. To achieve this zero angle of attack the illustrated device is designed to take into account the effect of the upward discharge of gas from the diffuser blades. This discharge of gas causes an upward flow of the liquid in a cylindrical or reactor column that is an upward extension of the circle defined by the area between the center axis of the main shaft to the tips of the rotating diffuser blades. Specifically, such discharge of gas produces a zone of liquid above the diffuser blades, which due to the presence of gas bubbles in that liquid, is less dense than the ambient liquid below the diffuser blades. This less dense liquid is displaced vertically upwardly from below by ambient density liquid. The vertical upward flow of the less dense liquid is called the lift pump effect. The ambient liquid that displaces the rising less dense liquid enters the reactor column between the rotating blades. This upward flow of ambient liquid affects the angle of attack between the rotating blades and the ambient liquid.

To achieve the desired zero angle of attack, in view of the aforementioned lift pump effect, the diffuser blades in the current best mode of the device, cooperatively engage through a formed internal passage, with the exterior of the rectangular spar which itself is in registered permanent engagement using welding or attachment components to fix it on the exterior of the mounting tube. Mating mounting attachment collars attached at the proper position to the exterior of the mounting tube and formed at the attachment end of the diffuser blades, hold the diffuser blade from sliding off the supporting spar during rotation in the fluid. The engagement of the internal passage of the diffuser blade over the rectangular spare, which has been properly positioned by affixing it at the correct position on the tube, or by rotating the mounting tube to place the spar in the correct position and then attaching it to the hub, maintains the diffuser blades fixed in a tilted or pitched position with the leading edges of the diffuser blades lowered to a determined angle to yield the zero angle of attack based on a number of factors noted below. The spar as noted must either be attached to the mounting tube at an angle, or rotated with the mounting tube which is then attached to the hub when the spar is properly positioned, such that, when the spar engages with the passage on the interior of the diffuser blade, the zero angle of attack is achieved.

The provision of the easily mounted and dismounted light weight diffuser blade over the spar, and engaged at a determined fixed angle thereon, provides the ability of the diffuser blades to be installed to yield an infinite number of different angles of attack when attached to the mounting tube and adjusted as needed. This angle adjustment is achieved simply by attaching the spar to the mounting tube, by welding or bolting or other means to hold the spar engaged with the mounting tube at the proper determined angle, in such a manner as to yield the desired angle of attack of the diffuser blade when it is cooperatively engaged over the spar. Or as noted, the spar can be affixed to the mounting tube, and then the mounting tube can be attached to the hub with the spar at correct position using a means for engagement of the hub to the mounting tube that will allow for adjustment of the position of the spar before it is fixed to the hub. Changing the angle of engagement of the rectangular spar by either rotating the mounting tube and affixing it to the hub, or by using a mounting tube with the spar positioned properly for a non rotational attachment to the hub, results in a changed angle of attack of the engaged diffuser blade. Of course, in addition to using a means to rotate the mounting tube and then engage it with the hub, the mounting tubes can also be manufactured with the spars attached at different angles to thereby yield the proper angle of attack of the attached diffuser blades. This makes changing the angle of attack of the diffuser blades to the indented purpose easily accomplished by simply changing the mounting tube to one which has the spar attached at the proper angle to engage the diffuser tube and yield the desired angle of attack.

Thus the diffuser blades may be easily manufactured of lightweight material with a properly dimensioned spar engaging passage and attachment collar and be used in a wide variety of liquids and at varying speeds and still yield the proper angle of attack simply by properly attaching the mounting tube to its engagement with the hub to yield the properly angled or positioned spar attached to its exterior. Adjustment of position of the spar to the proper point to engage the diffuser tube interior and hold the diffuser tube at the proper angle of attack is aided by the provision of a hub flange which attaches using fasteners to a mating flange affixed to the mounting tube. The hub flange is provided with a plurality of different hole combinations in the flange which will align with the holes formed in the mating flange to allow the mounting tube, and attached spar to be rotated into the proper position and held in that position by bolts or other fasteners affixed through the properly aligned holes in the hub flange and mating flange. By placing a plurality or large number of different holes in the hub flange, which when aligned with the mating flange will position the spar at varying positions about the center axis running from the hub through the mounting tube, great adjustability for the resulting angle of attack of the diffuser blade is achieved as well as providing substantial structural support to the diffuser blade from the properly positioned spar. Alternatively, these mounting tubes with attached spars could be manufactured in kits with each kit having spars positioned at different angles around the center axis of the mounting tube when attached to the hub directly. While this would eliminate the need for the plurality of different hole mating combinations between the hub flange and mating flange, and is anticipated by this patent, the preferred embodiment employs the hub flange with multiple alignable holes mating to the mating flange because of its adjustability which is especially important during installation and maintenance.

An object of this invention is the provision of an easily mounted and dismounted diffuser blade for rotation in a fluid to both mix the fluid and discharge gas into the fluid from the diffuser blade.

An additional object of this invention is the provision of such a diffuser blade that is light weight due to the provision of an internally engageable spar which reinforces the diffuser blade against rotational and lateral force generated when moving through a liquid.

Another object of this invention is the provision of a diffuser blade that is easily slid upon and engaged over a cooperatively engaging spar which will then maintain the angle of attack of the diffuser blade when rotating in the fluid.

A further object of this invention is to provide a diffuser blade that may be easily changed by slidably engaging the diffuser blade to and from its internal spar engagement.

Yet another object of this invention is the provision of a frame having a main shaft for rotating the diffuser blade in a fluid which may be cantilevered out of the fluid for maintenance or replacement of the diffuser blades.

A further object of this invention is to provide a fail safe system of fluid aeration wherein the diffuser blades aerating the fluid will cantilever out of the fluid should power to the air blower cease, thereby preventing clogging of the diffuser blades.

Yet another object of this invention is to provide a diffuser blade that is slidably mountable to a mounting tube and secured at the proper angle of attack for rotation and being able to change the angle of attack of the diffuser blade by simply changing or rotating the mounting tube in its affixation to the hub to yield a differently angled spar.

These together with other objects and advantages which will become subsequently apparent reside in the details of the construction and operation as more fully hereinafter described and claimed, reference being made to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

FIG. 5 shows an exploded view of the diffuser blade from the spar engaged upon the mounting tube.

FIG. 5*a* depicts the hub and the engagement of the mounting tubes to the hub using angle adjusting hub flanges.

FIG. 6 is a side cut away view along line 6—6 of FIG. 3 depicting the internal engagement of the spar and mounting tube.

FIG. 7 depicts the hub flanges which provide a plurality of mounting holes aligned to vary the angle of an attached mounting tube.

DETAILED DESCRIPTION OF THE PREFERRED EMBODIMENTS

Figure 1:
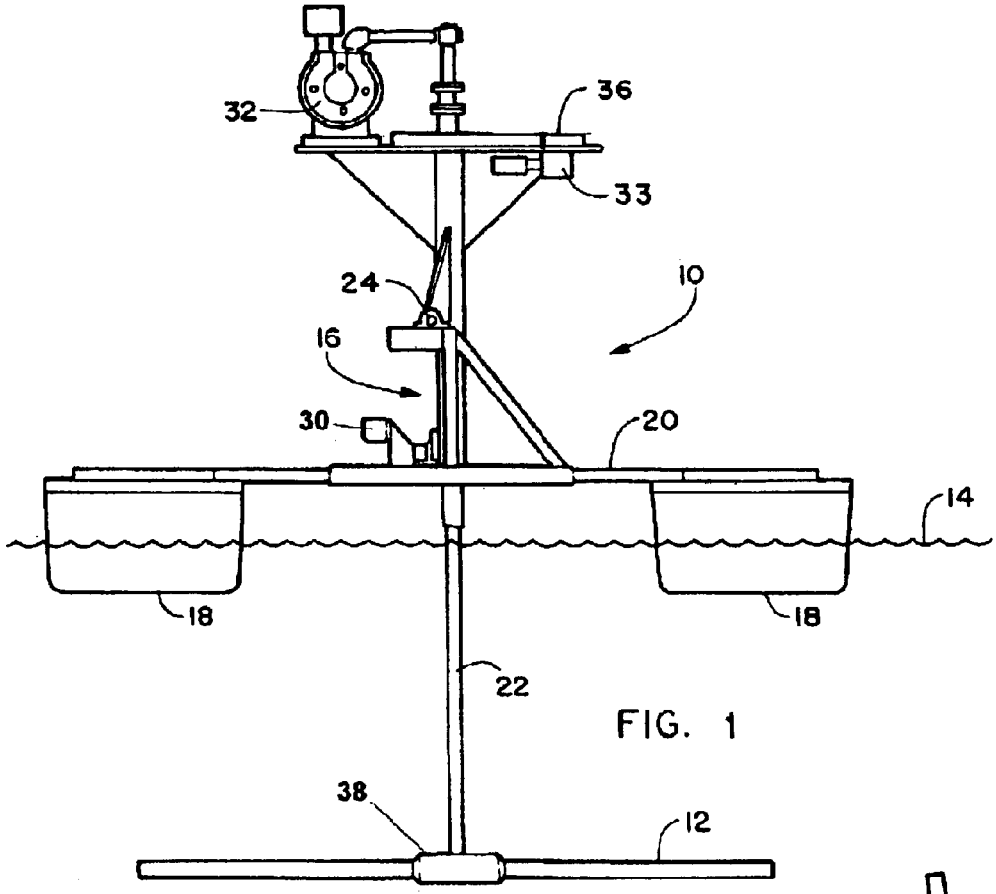
FIG. 1 depicts a view of the aeration system herein disclosed showing improved diffuser blade affixed to a support shaft on a support frame with the diffuser blade in a submerged position.

Referring now to the drawings, wherein similar parts of the invention are identified by like reference numerals, there is seen in FIGS. 1–8 the various components of the disclosed device 10 that combine to yield an improved apparatus for both mixing and introducing gas into a large body of liquid such as a lake, reservoir, or sewage pond where proper aeration is a constant concern. As noted above the disclosed device 10 consists of two components including the spar supported diffuser blade 12 which rotates submersed in the liquid 14 and the support frame 16 which serves as a floating or elevated mount for the diffuser blade 12 above the liquid 14. As described above the improved diffuser blade 12 and its unique spar engaging and supporting mounting system can be used to improve the performance and ease the maintenance of older gas mixing systems by adapting it for attachment to such systems using the unique spar 42 affixed to the mounting tubes 40 which would be adapted for attachment to existing devices and as such it could thus be used by itself without the support frame 16. However, when combined with the unique support frame 16 and with the components and cantilever ability of the disclosed support frame 16, the diffuser blade 12 and support frame 16 combine to yield exceptional function and utility in aeration, maintenance, and safety.

Figure 2:
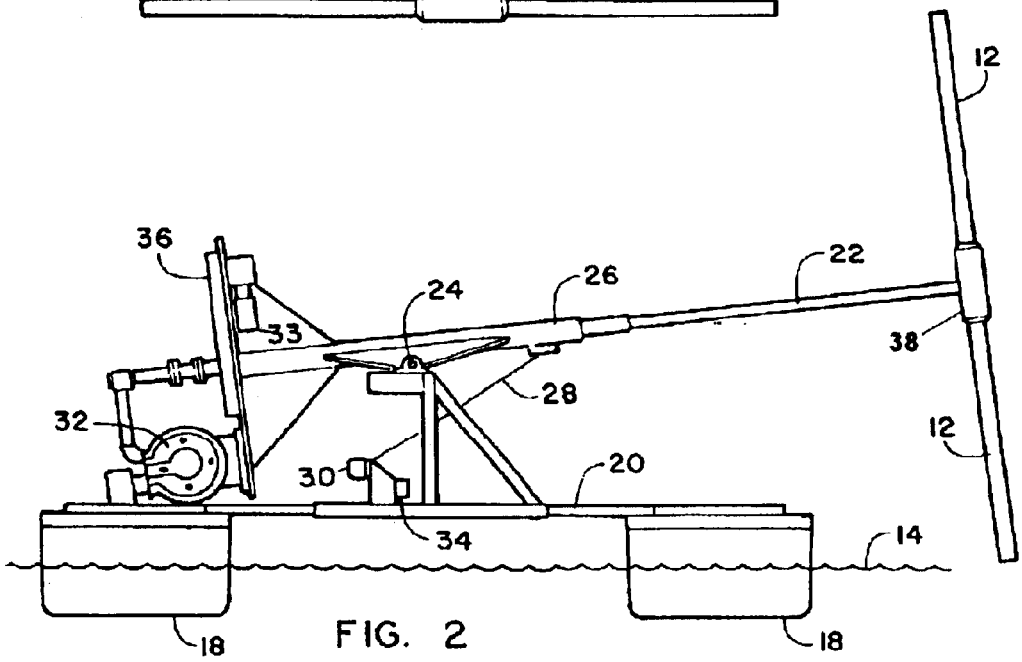
FIG. 2 depicts a view of the aeration system herein disclosed showing the diffuser blade affixed to the support shaft in a raised position.
Figure 3:
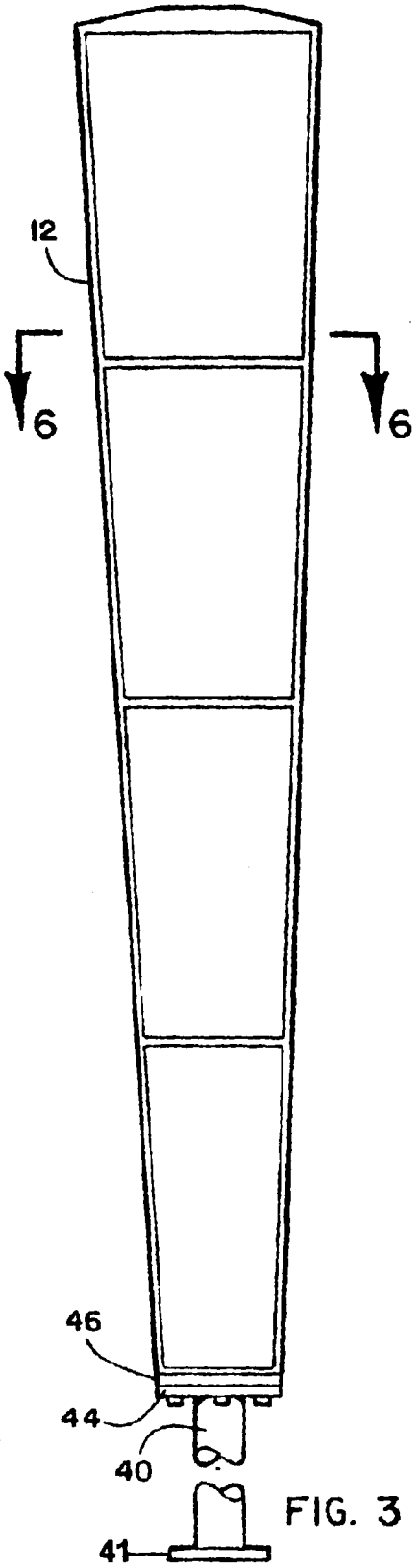
FIG. 3 depicts a top view of the diffuser blade engaged with the mounting tube.
Figure 4:
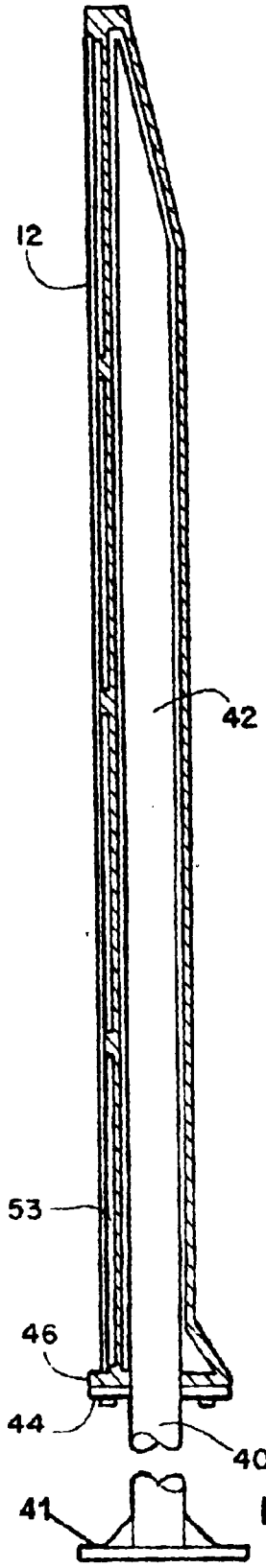
FIG. 4 depicts a side cut away view of the diffuser blade showing the elongated spar engaged with both the mounting tube and the interior of the diffuser blade.

The support frame 16 is best depicted in FIGS. 1 and 2, is designed to provide supported above, or float upon, the liquid 14 pool and thereby provide the platform for the various described components herein to rotate the diffuser blades 12 submerged in the liquid 14. The support frame 16 is adapted to maintain a position above or float upon the surface of the liquid 14 which in the depicted embodiment uses a means to maintain the frame in position over a liquid pool such as pontoons 18 which are attached to a base 20. The pontoons 18 or other flotation means would have sufficient flotation ability to carry all of the weight of the various components mounted on the support frame 16. Of course those skilled in the art will realize that a pier or bridge or cable support system or other means to maintain the frame in position elevated above the liquid 14 could be used, and such are anticipated.

A main shaft 22 is rotationally attached to the support frame 16 using a means for rotational engagement of the main shaft 22 with the support frame 16 which in the current embodiment is accomplished by hinge 24 which engages a collar 26 surrounding the upper portion of the main shaft 22 which is rotationally engaged therein. Consequently, rotating the collar 26 from a position perpendicular to the surface of the liquid 14 to a position substantially parallel to the surface of the liquid 14 will thus cantilever the main shaft 22 from a submerged position shown in FIG. 1 to an elevated position shown in FIG. 2. In the elevated position the main shaft 22 will still rotate to thereby ease the installation and maintenance process when attaching the diffuser blades 12 to their sealed engagement with the main shaft 22.

In a current preferred mode of the device 10 the rotation of the main shaft 22 between the elevated position and the submerged position is achieved by a cable 28 engaged with a winch 30 which is user activateable. To rotate the main shaft 22 to the submerged position, the winch is energized and the cable 28 is wound on the winch 30 and the main shaft 22, which is rotationally engaged inside the collar 26, is pulled into the liquid 14 when the collar 26 descends, thus submerging the diffuser blades 12 which are affixed to the distal end of the main shaft 22 into the liquid 14.

Also in a preferred mode of the device 10 the main shaft 22 is counter balanced using weights or components of the device 10 itself such as pump 32 or other means render the main shaft 22 substantially top heavy at the end above the frame 20. This counter balance is best if it has sufficient weight to generate sufficient force whereby the main shaft 22 will default to and rotate to the elevated position unless pulled and held in the submerged position. Consequently, in the submerged position in the liquid 14, the main shaft 22 with the diffuser blades 12 attached, will only remain submerged so long as a means to rotate and hold the mainshaft in the submerged position is engaged such as the cable 28 or a similar tether means is wound on the winch 30 and locked in position around the winch 30, or if the cable is wound upon the winch and another locking means is engaged to hold the mainshaft 22 in the submerged position. As such, in a current preferred mode of the device 10, the main shaft 22 with one or a plurality of diffuser blades 12 attached, will always default to the elevated position, unless held submerged by a means to rotate and hold the main shaft 22 in the submerged position with the main shaft 22 is substantially perpendicular to the base 20. Defaulting to the elevated position insures that the diffuser blades 12 are always removed from the fluid 14 when the compressed air source communicating compressed air through the diffuser blades 12 and through the diffuser material 53 into the surrounding liquid 15 ceases. This prevents particulate in the fluid from clogging the diffuser material 53 mounted over the apertures 52 in the top of the diffuser blades 14 when compressed air is not available and being communicated through the apertures 52 and the diffuser material 53.

Currently the preferred means to maintain the main shaft 22 in the submerged position is an electro magnet 34 which contacts the collar 26 or a mating plate thereon, and holds the main shaft 22 perpendicular to the base 20 only as long as electrical power is provided to that electro magnet 34. It would be best if the electro magnet 34 and the pump 32 are both energized by the same electrical force. If for some reason the electrical power fails to the pump 32, which because of the potential for particulate clogging the diffuser blade 12 is hazardous the diffuser blade 12, the magnet 34 will cease to function concurrently or just before the positive pressure from the pump 32 ceases and the main shaft 22 and diffuser blade 12 will rotate to the default elevated position with both elevated out of the liquid 14. Of course those skilled in the art will realize that other means to maintain the main shaft 22 in the submerged position such as a solenoid, electrical locking mechanism for the cable 28 or winch 30, or other devices might be used and consequently such are anticipated in the scope of this patent.

The main shaft 22 is an elongated tube having axial passage defining a conduit running axially therethrough which communicates in a sealed engagement at the top end with a pressurized air source such as compressor or pump 32. As shown in FIG. 1 the pump 32 if mounted at the top end of the main shaft 22 also provides some or all of the counter weight to rotate the main shaft 22 to the default elevated position should electrical power fail thereby disengaging the electro magnet 34 or any other means to maintain the main shaft 22 in the submerged position. However weights could also be used alone or in combination with the pump 32 to yield the proper force as a counter weight. Also weights alone might be used as the counter weight and a hose (not shown) might be attached between a remote compressed air source and the main shaft 22 to thereby provide a compressed air source into the conduit running axially through the main shaft 22 for communication of compressed air to the attached diffuser blades 12 at the distal end of the main shaft.

Rotation of the main shaft 22 which in turn rotates the diffuser blade 12 at the distal or lower end of the main shaft 22 is provided by a means to rotate the main shaft 22 which as depicted is provided by a motor 33, engaged with the upper end of the main shaft 22 using a gearbox 36 or similar means for engagement of the motor 33 to rotate the main shaft 22. In cases of an electrical motor a motor controller would be used to control the rotation speed imparted to the main shaft 22 by the motor 33 to achieve the proper speed of the diffuser blades 12 in the liquid 14 at the chosen angle of attack of the diffuser blade 12. If course other types of motors might be used such as compressed air, hydraulic, or internal combustion motors with the appropriate rotation speed control means and such are anticipated.

At the lower end of the main shaft 22 a hub 38 is located which has a plurality of mounting tubes 40 attached to the hub 38 using a hub flange 41 which would bolt or otherwise be attached to the hub 38. The hub flange 41 provides an easy means to attach the mounting tube 40 to the hub 38 and the plurality of holes 58 in the hub flange 41 provides a means to rotate the mounting tube 40 to position the spar 42 at the proper point around the center axis of the mounting tube 40 to engage the diffuser blade 12 and hold it in place at the proper angle of attack. Or should additional support be desired, the mounting tubes 40 may be attached to a sealed engagement with the hub 38 by sliding the passage 51 extending axially inside the mounting tubes 40 over a plurality of appropriately diametered supporting nipples 39 projecting substantially perpendicular to the center axis of the main shaft 22. This would be the case where longer diffuser blades 12 are used and once slid upon the nipples 39, the hub flange 41 would be attached to the hub 38 and the position of the spar 42 around the center axis of the mounting tube 40 would be adjusted to the proper position wherein the hub flange 41 would be fixedly secured to the hub 38 thereby securing the mounting tubes 40 to a sealed engagement with the hub 38. Nipples 39 are used when more support for the mounting tubes 40 is needed as in cases where longer diffuser blades 12 or diffuser blades 12 with longer mounting tubes 40 are employed. However, where shorter diffuser blades 12 or mounting tubes 40 are used and extra support from the nipples 39 is not required, the mounting tubes 40 could also be directly attached to the hub 38 by attaching the hub flange 41 to the hub 38 without the nipples 39.

Each mounting tube 40 has an axial passageway 51 in sealed communication with the compressed air supply from the conduit formed internally and running axially through the main shaft 22 through the hub 38 and through a flange aperture 56 communicating through the hub 38 or from the hub 38 through the distal end of the nipple 39 if used. Pressurized air or gas is thus communicated from the pump 32 through the mainshaft 22 through the hub 38 and to the axial passage 51 extending axially through the mounting tubes 40. If the nipples 39 are employed, the pressurized air communicates from the hub 38 through nipple 39 which communicates through the flange and to the axial passage 51 of the mounting tubes 40. In this manner, compressed air is communicated from the pressurized air source communicating with the conduit formed in the main shaft 22 at the top end of the main shaft 22 to the distal ends of each mounting tube 40 and into the diffuser blades 12 which are in sealed engagement to the mounting tubes 40.

Attached to the exterior of the mounting tube 40 is an elongated spar 42 which in the current best mode provides the necessary structural support to the diffuser blade 12 when frictionally engaged at the angle determined by the position of the spar 24 in relation to the center axis of the mounting tube 40. The structural support of the spar 42 is sufficient to maintain the diffuser blade 12 structurally when exposed to the various force vectors generated from the liquid 14 being forced against the rotating diffuser blade 12 at the desired angle of attack.

In the current best mode of the device 10 the spar 42 is generally a "U" shape and as shown in FIG. 6 and fixedly engaged by welding or other means for fixed engagement, over the exterior circumference of the projecting mounting tube 40 on one end and within a cooperating engagement passage 43 axially formed in the interior of the diffuser blade 12 on the other end, to provide support to the diffuser blade 12 from both the lateral forces imparted upon it from rotating in the fluid as well as the twisting forces imparted upon the diffuser blade 12 from rotating at the determined angle of attack. Using the slide-on engagement of the diffuser blade 12 over the spar 42 which is properly mounted on the mounting tube 40 which is properly attached to the hub 38 using the appropriate holes 58 to yield the proper angle of attack to the diffuser blade 12, greatly reduces the time and cost of replacing or repairing clogged or otherwise impaired diffuser blades 12 and the cost of the blades themselves since they can be molded from lightweight material such as plastic which will be sufficient to hold up to the forces imparted when moving through the fluid 14 with added strength provided by the cooperatively engaged spar 42. This slidable engagement of the spar 42 inside the engagement passage 43 axially formed in the diffuser blade 12 and at the proper angle of attack upon the mounting tubes 40 also allows the mounting tubes 40 to be pre attached to the hub 38 using the hub flange 41 or by having the mounting tubes 40 overlap the nipples 39 and attach using the mating hub flange 41. Once the mounting tubes 40 are so mounted, with the spar 42 appropriately rotated to the proper position to yield the proper angle of attack of the diffuser blades 12, they provide an easy slid-on target for the unwieldy elongated diffuser blades 12 over the cooperatively engaging spar 42 during mounting and dismounting which saves time on initial installation and over the life of the device 10.

Further, by using the spar 42 to carry and transfer to the mounting tube 40 the majority of the force imparted to the diffuser blade 12 it is easy to change the total length of the diffuser blade 12 to a longer or shorter total length to match the desired mixing and aeration for the job intended. A longer diffuser blade 12 is carried on a longer spar 42 which optionally slides over a nipple 39 for extra support, whereas a shorter one would be supported on a shorter spar 42 and mounting tube 40 which would attach directly to the hub 38. As long as the mounting tubes 40 and nipples 39 if used, are sized to support the force of the longest spar 42 and diffuser blade 12 that is used, any size diffuser blade 12 below the longest is easily substituted.

As noted above, the spar 42 is shaped about its circumference to engage with an engagement passage 43 axially formed inside the diffuser blade 12. Consequently the angle of attack of the diffuser blade 12 through the liquid is easily achieved and permanantly maintained by using a mounting tube 40 which has the spar 42 attached in the proper position to yield the desired angle of attack of the diffuser blade 12 through the liquid 14 when the mounting tube 40 is attached to the hub 38. The mounting tubes 40 with a flange 41 affixed to them, are attached to a sealed engagement with the hub 38 by engaging the hub flange 41 using bolts or similar fasteners which are locked in engagement with the hub 38. As can be seen, the hub flange 41 has a plurality of holes 58 which are positioned to line up with appropriately positioned holes in the hub 38 and position the spar 42 at different positions depending on the amount of rotation of the mounting tube 40 and the holes in the hub 38. As can be seen in FIG. 7, a large number of holes 58 can be placed in the hub flange 41 at both its ends to allow for a large number of different angles which the mounting tube 40 may be rotated to thereby rotate the position of the spar 42 about the center axis of the mounting tube 40 and thereby rotate and maintain the position of the diffuser blade 12 engaged over the spar 42. Should a different angle of attack be required, the attachment of the mounting tube 40 to the hub 38 may be rotated one way or the other by aligning the appropriate holes in the hub flange 41 and holes in the hub 38 which line up with the holes 58 in the hub flange 41 at differing angles of rotation. Again, once rotated and attached to place the spar 42 in the proper position to hold the diffuser blade 12 in the desired proper angle of attack, that angle of attack is maintained by the spar 42 and diffuser blade 12 engagement until it is changed by re-mating the hub flange 41 to the hub 38.

The removable attachment of the diffuser blade 12 over the spar 42 and onto the mounting tube 40, is maintained by a means of attachment of the diffuser blade to the mounting tube using mating mounting flanges. A first mounting flange 44 mounted about the circumference of the mounting tubes 40 adjacent to the spar 42 attaches to a second mounting flange 46 formed into or attached to the mounting end of the diffuser blade 12. Apertures or slots in both these mounting collars would substantially align so that fasteners could be placed therethrough thereby providing a means of attachment of the mounting tube 40 to the mounting end of the diffuser blade 12. Since the majority of the twisting and other forces imparted to the diffuser blade 12 rotating at the angle of attack in the liquid 14 are transmitted to the spar 42 inserted in the engagement passage 43, the mounting flange 46 on the diffuser blade 12 is relieved of having to carry this major load and can be made of lighter material sufficient to withstand substantially the centrifugal force that might develop and pull the diffuser blade 12 off of its engagement with the spar 42.

The engagement of the mounting flanges 44 and 46 would also sealably engage the interior cavity 49 of the diffuser blade 12 with the axial passages 51 running the length of the mounting tubes 40 to thereby communicate the pressurized gas or air from the pressurized air source to the interior cavity 49. From the interior cavity 49 the pressurized air can them be communicated through apertures 52 formed in the discharge surfaces 50 of the diffuser blades 12 and through the adjacent diffuser material 53 and into the fluid 14.

In order to maximize the shearing effect of the flow of liquid 14 relative to the rotating diffuser blades 12, it is desirable that the resultant angle of attack of the top surface of the diffuser material 53 attached upon the upper or discharge surfaces 50 of the diffuser blades 12 with regard to the relative liquid flow, be essentially zero or somewhat greater. In other words, such fluid flow should be generally parallel to or tangential to the top surface of the diffuser material 53 located upon the discharge surfaces 50. To achieve this zero angle of attack the disclosed device 10 is designed to take into account the effect of the upward discharge of gas from the diffuser blades 12. This discharge of gas causes an upward flow of the liquid in a cylindrical or reactor column that is an upward extension of the circle defined by the area between the center axis of the main shaft 22 to the tips of the rotating diffuser blades. Specifically, such discharge of gas produces a zone of liquid above the diffuser blades 12, which due to the presence of gas bubbles in that liquid, is less dense than the ambient liquid below the diffuser blades. This less dense liquid is displaced vertically upwardly from below by ambient density liquid. The vertical upward flow of the less dense liquid is called the lift pump effect. The ambient liquid that displaces the rising less dense liquid enters the reactor column between the rotating blades 12. This upward flow of ambient liquid affects the angle of attack between the rotating blades and the ambient liquid.

To achieve the desired zero angle of attack, in view of the aforementioned lift pump effect, as noted earlier, the diffuser blades 12 in the current best mode of the device are mounted over the spar 42 which has been rotated to the proper position and secured to the hub 38 by the aforementioned attachment of the hub flange 41 using the appropriate holes 58 respectively to achieve a position of the spar 42 which will yield the zero angle of attack for the diffuser blade 12 when it is engaged over the spar 42.

Figure 8:
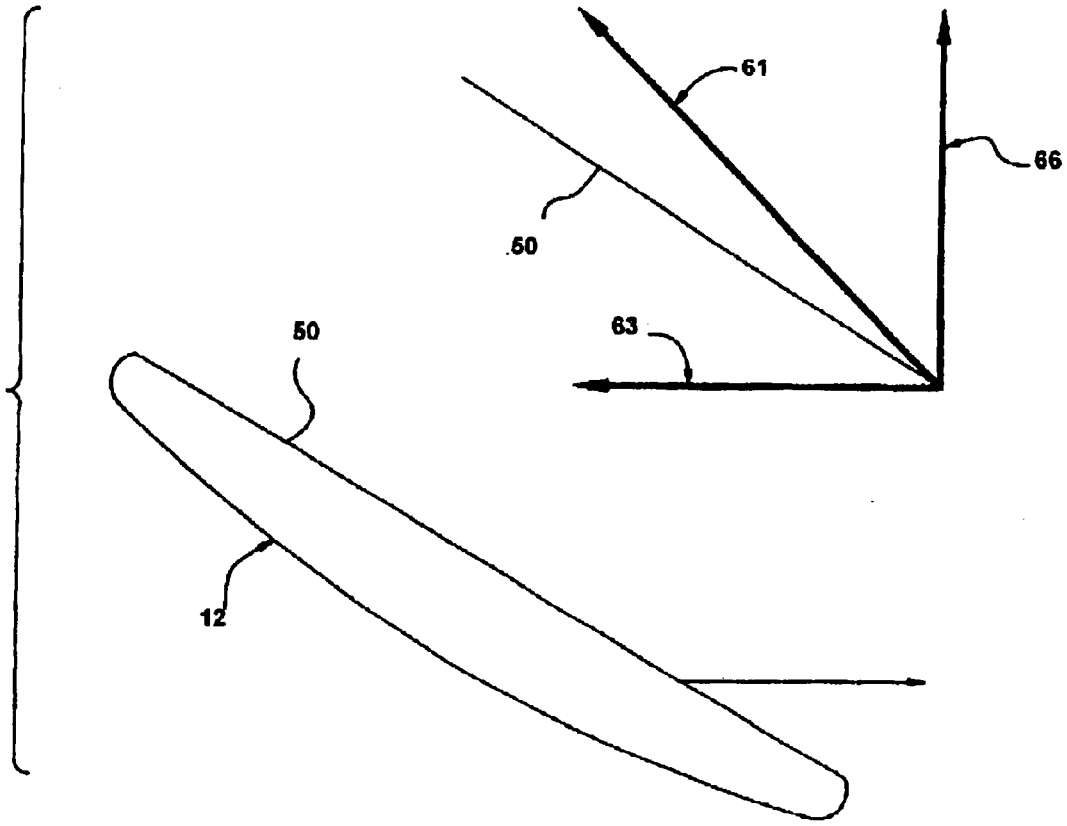
FIG. 8 depicts a vector analysis of the proper angle of attack of the diffuser blade when moving through the fluid.

FIG. 8 illustrates the plane of the discharge surface 50 of the rotating diffuser blade 12 relative to the resultant vector 61 of the liquid 14. The resultant vector 61 is the vectorsum of (I) the horizontal vector 63 produced by the diffuser blade's rotating forward motion, and (ii) the vertical vector 66 produced by the liquid column's upward motion. When the angle of the discharge surface 50 essentially coincides with the angle of the resultant vector 61, the desirable angle of attack of approximately zero is achieved. It may be seen from this relationship that, for a given tilt or angle of incidence of the member surface, the desired zero angle of attack can be maintained over a range of lift pump effect vertical liquid flow rates by selectively varying the speed of rotation of the members. Using the above vector analysis the relationship between the vector 63 in the horizontal plane determined by speed of rotation of the blade, the vector 66 determined by the vertical speed of the rising liquid, the angle of incidence of the blade discharge surface 50, and the vector sum of the vectors 63 and 66 as represented by resultant vector 61. The angle at which the rotating inclined diffuser surface 50 is impacted by the liquid is the angle of attack and is shown as the angle between resultant vector 61 and surface 50. This angle is maintained through the life of the blade member 12 by the engagement of the properly positioned spar 42 with the engagement passage 43 of the blade member 12.

Compressed gas communicated to the interior cavity 49 of the diffuser blades 12 from the conduit running through the main shaft 22 is as noted communicated to the interior of the diffuser blades 12 through the generally "U" shaped spar 42 which has an open side edge along substantially its entire length to thereby aid in the dispersion of compressed air into the entire length of the interior cavity 49 of the diffuser blade 12. Once pressurized the interior cavity 49 communicates the pressurized air through the discharge material 53 from the plurality of apertures 52 spaced and positioned to achieve the proper disbursement of gas into the liquid 14 at the determined angle of attack and speed of the diffuser blade 12. Between the apertures 52 and the liquid 14 a diffuser material 53 is attached to the discharge surface 50 of the diffuser blade 12 provide the proper discharge of compressed air into the liquid 14. The diffuser material 53 provides proper defusing of the air into the liquid.

The device herein shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed in accordance with the spirit of this invention. All such changes, alterations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and will be appreciated that in some instance some features of the invention will be employed without a corresponding use of other features without departing from the scope of the invention as set forth in the following claims.

What is claimed is:

1. An apparatus for introducing gas into a large body of liquid comprising:

at least one diffuser blade having a generally planar top wall and having a bottom wall intersecting said top wall;

said diffuser blade having an attachment end and a distal end opposite said attachment end;

an interior cavity of said diffuser blade defined by the area between said top wall and said bottom wall;

said top wall having a plurality of discharge apertures communicating therethrough;

a blade aperture communicating with said interior cavity at said attachment end;

a mounting tube, said mounting tube having an first end and a second end and having a mounting tube center axis therethrough;

an axial passage communicating between said first end and said second end of said mounting tube;

a spar positioned on an exterior surface of said mounting tube;

an engagement passage formed in said interior cavity dimensioned to engage a distance over said spar and said mounting tube thereby placing said diffuser blade in a mounted position;

means for cooperative engagement of said diffuser blade in said mounted position;

means for substantially sealed engagement of said blade aperture with said axial passage;

said second end of said mounting tube adapted for attachment to a rotatable hub having a compressed air supply with said compressed air supply in substantially sealed communication with said axial passage at said second end when so attached thereby allowing communication of said compressed air supply to said discharge apertures; and means for adjustment of the position of said spar on said exterior surface to a plurality of positions around said mounting tube center axis thereby making the angle of said top wall of said diffuser blade adjustable when placed in said mounted position.

2. The apparatus for introducing gas into a large body of liquid of claim 1 wherein said means for adjustment of the position of said spar on said exterior surface to a plurality of positions around said mounting tube center axis comprises:

a flange attached to said second end of said mounting tube;

said flange having a plurality of flange apertures communicating therethrough;

said plurality of flange apertures alignable with a plurality of hub apertures by rotating said flange to allow attachment of said flange to said hub a plurality of positions; and fastener means to engage said flange apertures to said hub apertures.

3. The apparatus for introducing gas into a large body of liquid of claim 1 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

4. The apparatus for introducing gas into a large body of liquid of claim 2 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

5. The apparatus for introducing gas into a large body of liquid of claim 1 additionally comprising:

a diffuser pad attached to said planar top wall adjacent to said discharge apertures whereby compressed air from said discharge apertures is further diffused upon exit from said diffuser blade.

6. The apparatus for introducing gas into a large body of liquid of claim 1 additionally comprising:

a diffuser pad attached to said planar top wall adjacent to said discharge apertures whereby compressed air from said discharge apertures is further diffused upon exit from said diffuser blade.

7. An apparatus for introducing gas into a large body of liquid comprising:

at least one diffuser blade having a generally planar top wall and having a bottom wall intersecting said top wall;

said diffuser blade having an attachment end and a distal end opposite said attachment end;

an interior cavity of said diffuser blade defined by the area between said top wall and said bottom wall;

said top wall having a plurality of discharge apertures communicating therethrough;

a blade aperture communicating with said interior cavity at said attachment end;

a mounting tube, said mounting tube having an first end and a second end and having a mounting tube center axis therethrough;

an axial passage communicating between said first end and said second end of said mounting tube;

a spar positioned on an exterior surface of said mounting tube;

an engagement passage formed in said interior cavity dimensioned to engage a distance over said spar and said mounting tube thereby placing said diffuser blade in a mounted position;

means for cooperative engagement of said diffuser blade in said mounted position;

means for substantially sealed engagement of said blade aperture with said axial passage;

a hub, said hub attached to the bottom end of a mainshaft communicating with a hub cavity;

said axial passage at said second end in sealed communication with said hub cavity thereby allowing communication of said compressed gas supply to said discharge apertures;

said mainshaft adapted at a top end to sealed engagement with a compressed gas supply;

said mainshaft rotatably mounted to a frame;

means to rotate said mainshaft;

means to support said frame above said liquid; and means for adjustment of the position of said spar on said exterior surface to a plurality of positions around said mounting tube center axis thereby making the angle of said top wall of said diffuser blade adjustable when placed in said mounted position.

8. The apparatus for introducing gas into a large body of liquid of claim 7 additionally comprising:

said hub having a raised position above said body of liquid and having a submerged position submersed in said body of liquid; and said hub biased toward said raised position by default; and means to maintain said hub in said submerged position so long as said compressed gas supply is communicated to said axial passage, wherein said hub will move to said raised position should said compressed gas supply to said axial passage cease.

9. The apparatus for introducing gas into a large body of liquid of claim 8 wherein said means to maintain said hub in said submerged position so long as said compressed gas supply is communicated to said axial passage comprises:

said mainshaft in cantilevered engagement with said frame;

means to make said top end of said mainshaft heavier than said bottom end of said mainshaft with said hub and diffuser blade or operatively engaged thereto;

attachment means having a first position holding said hub submerged and a second position releasing said hub to cantilever out of said liquid body; and control means to cause said attachment means to move to said second position should said compressed gas supply to said axial passage cease.

10. The apparatus for introducing gas into a large body of liquid of claim 9 wherein said attachment means is an electro magnet with said first magnetically holding said hub in said submerged position; and said control means is a switch which turns off said electro magnet should said compressed gas supply to said axial passage cease.

11. The apparatus for introducing gas into a large body of liquid of claim 7 wherein said means for adjustment of the position of said spar on said exterior surface to a plurality of positions around said mounting tube center axis comprises:

a flange attached to said second end of said mounting tube;

said flange having a plurality of flange apertures communicating therethrough;

said plurality of flange apertures alignable with a plurality of hub apertures by rotating said flange to allow attachment of said flange to said hub a plurality of positions; and fastener means to engage said flange apertures to said hub apertures.

12. The apparatus for introducing gas into a large body of liquid of claim 8 wherein said means for adjustment of the position of said spar on said exterior surface to a plurality of positions around said mounting tube center axis comprises:

a flange attached to said second end of said mounting tube;

said flange having a plurality of flange apertures communicating therethrough;

said plurality of flange apertures alignable with a plurality of hub apertures by rotating said flange to allow attachment of said flange to said hub a plurality of positions; and fastener means to engage said flange apertures to said hub apertures.

13. The apparatus for introducing gas into a large body of liquid of claim 7 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

14. The apparatus for introducing gas into a large body of liquid of claim 8 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

15. The apparatus for introducing gas into a large body of liquid of claim 11 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

16. The apparatus for introducing gas into a large body of liquid of claim 12 additionally comprising:

an elongated nipple adapted for attachment to said hub at a first end and having a distal end opposite said first end;

said distal end of said nipple having an orifice in communication with said compressed air supply; and said axial passage dimensioned to slidably engage over said nipple when said nipple is attached to said hub.

17. The apparatus for introducing gas into a large body of liquid of claim 1 wherein said angle of said top wall is adjusted to a zero angle of attack when rotating in said body of liquid.

18. The apparatus for introducing gas into a large body of liquid of claim 2 wherein said angle of said top wall is adjusted to a zero angle of attack when rotating in said body of liquid.

19. The apparatus for introducing gas into a large body of liquid of claim 11 wherein said angle of said top wall is adjusted to a zero angle of attack when rotating in said body of liquid.

20. The apparatus for introducing gas into a large body of liquid of claim 1 wherein said angle of said top wall is adjustable to an infinite number of angles by the change in position of the location of said spar.

* * * * *